137-13 SR
3/10/81 XR 4,254,800

United States Patent [19] [11] 4,254,800
Masaki [45] Mar. 10, 1981

[54] FLUID FLOW RATE CONTROL APPARATUS

[75] Inventor: Kenji Masaki, Yokohama, Japan

[73] Assignee: Nissan Motor Company, Limited, Yokohama, Japan

[21] Appl. No.: 48,080

[22] Filed: Jun. 13, 1979

Related U.S. Application Data

[63] Continuation of Ser. No. 801,394, May 27, 1977, abandoned.

[51] Int. Cl.[3] ..... F15D 1/02
[52] U.S. Cl. ..... 137/827; 137/13
[58] Field of Search ..... 137/13, 251, 807, 827, 137/DIG. 10

[56] References Cited

U.S. PATENT DOCUMENTS

| | | | |
|---|---|---|---|
| 2,763,125 | 9/1956 | Kadosch et al. | 137/827 X |
| 3,071,154 | 1/1963 | Cargill et al. | 137/807 |
| 3,258,685 | 6/1966 | Horton | 137/827 X |
| 3,405,728 | 10/1968 | Dexter | 137/251 |
| 3,438,384 | 4/1969 | Horvitz | 137/807 X |
| 3,548,853 | 12/1970 | McEven | 137/807 |

FOREIGN PATENT DOCUMENTS

| | | |
|---|---|---|
| 390580 | 4/1933 | United Kingdom . |
| 893445 | 4/1962 | United Kingdom . |
| 1385551 | 2/1975 | United Kingdom . |

*Primary Examiner*—William R. Cline
*Attorney, Agent, or Firm*—Robert E. Burns; Emmanuel J. Lobato; Bruce L. Adams

[57] ABSTRACT

Charging means is provided in a fluid flow path for charging the fluid. Another means is provided downstream of the charging means in such a manner as to be outside of the fluid flow path, applying electrostatic or magnetic force to the charged fluid in order to control the flow rate of the fluid.

5 Claims, 7 Drawing Figures

FLUID FLOW RATE CONTROL APPARATUS

This is a continuation application of parent application, Ser. No. 801,394, May 27, 1977 which is now abandoned.

FIELD OF THE INVENTION

The present invention relates to an apparatus for controlling a flow rate of fluid by means of electrostatic or magnetic force.

BACKGROUND OF THE INVENTION

When fluid is conveyed through, for example, a conduit or pipe under pressure, a flow rate is usually controlled by a metering orifice and a suitable actuator such as an electromagnetic valve, etc. The actuator, based on a control signal applied thereto, controls the flow rate of fluid by changing the pressure applied to the fluid or a cross sectional area of the pipe. However, the actuator mechanically controls the flow rate so that it is unable to abruptly change the flow rate due to a relatively large transient time inherent in the mechanically operated actuator. Furthermore, in the case where the flow rate is controlled by "open" and "close" operations of the actuator, undesirable pulsating flow is caused. Therefore, the prior art has not been suitable for an accurate control of the flow rate.

SUMMARY OF THE INVENTION

The present invention sets forth a new concept in an apparatus for control of a flow rate of fluid, which control is carried out by using electrostatic or magnetic force. The apparatus embodying the present invention comprises: charging means provided in a fluid flow path for charging the fluid; another means provided downstream of the charging means in such a manner as to be outside of the fluid flow path, applying electrostatic or magnetic force, the magnitude of which is controlled by still another means, to the charged fluid, thereby to control the flow rate of the fluid.

DESCRIPTION OF THE PREFERRED EMBODIMENTS

Figure 1:
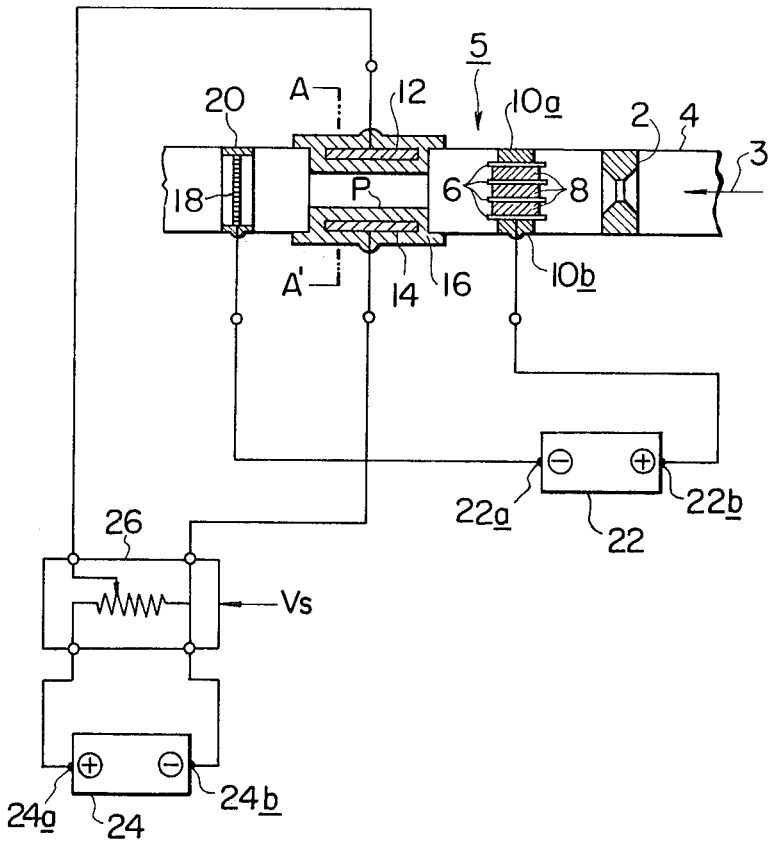
FIG. 1 is an illustration of a first preferred embodiment of the present invention.

Throughout the drawings and the following description like parts are designated by the same reference numerals.

Reference is now made to FIG. 1, which illustrates a first preferred embodiment of the present invention. A metering orifice 2 is provided in a suitable fluid pipe 4 for, as is well known, regulating the amount of fluid flow passing therethrough. Charging means 5 is provided downstream of the metering orifice 2, comprising: a plurality of pipes 6 each of which is made of metal and has a small cross sectional area; charging electrodes 8 each arranged between two small pipes 6; and insulators 10*a* and 10*b* for positioning an assembly, which consists of the pipes 6 and the electrodes 8, in the pipe 4 as well as electrically insulating the assembly from the pipe 4. Each of the small pipes 6 are electrically connected to a positive terminal 22*b* of a high voltage power source 22, and on the other hand, the power source 22 is electrically connected, through its negative terminal 22*a*, to a mesh electrode 18 which is fixedly installed in the pipe 4 in an electrically insulative manner by means of a member 20 made of an insulative material. A pair of electrodes 12 and 14 are provided upstream of the mesh electrode, and electrically connected, through a control signal generator 26, to negative and positive terminals 24*b* and 24*a* of a high voltage power source 24, respectively. The electrodes 12 and 14 are surrounded by insulative materials 16.

With this arrangement, fluid is applied to the pipe 4 in a direction as indicated by an arrow 3. Then, the fluid is, in this case, positively charged when passing through the metal pipes 6 in that the electrodes 8 are connected to the positive terminal 22*b* of the power source 22, the output potential of which is, for example, within a range from several to several tens of kilo-voltages. Following, the fluid flow is deviated towards a surface "p" of the insulator 16, in that the fluid flow is repelled and attracted by the electrodes 12 and 14, respectively, by electrostatic force. As a result, the flow rate is controlled in accordance with the voltage applied to the electrodes 12 and 14, which voltage is in turn controlled by a control signal Vs fed to the control signal circuit 26. In the above, if the surface "p" is made uneven for the purpose of increasing fluid resistance, the flow rate can be more effectively controlled. The charged fluid is then discharged when passing through the mesh electrode 18 connected to the negative terminal 22*b*.

Arrangement in FIG. 1 can be modified in various manners. By way of example, (1) the mesh electrode 18 can be omitted, and (2) the flow rate control can be carried out by only using the mesh electrode 18 and one of the electrodes 12 and 14. In these cases, it goes without saying that the control signal Vs should be employed in order to control the flow rate, although not shown in the drawing. Furthermore, the orifice 2 is not necessarily positioned as in FIG. 1, but, can be positioned in a discretionary portion, for example, downstream of the charging means 5 or the mesh electrode 18. Still furthermore, the small pipes 6 of the charging means 5 can be replaced by electrodes of needle type, or mesh type, etc.

Figure 2B:
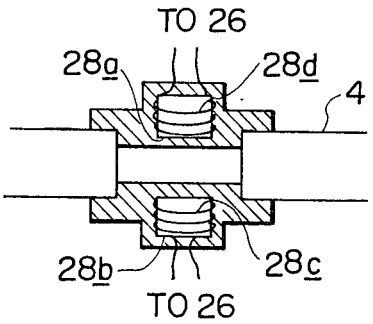
FIG. 2*b* is an illustration of a modification of a portion of FIG. 1.
Figure 2A:
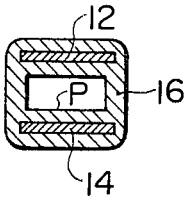
FIG. 2*a* is a cross sectional view taken along a line A—A' in FIG. 1.

FIG. 2*a* is a cross section of the control means of rectangular shape which is usable for applying the electrostatic force to fluid flow passing therethrough, however, it is not limited to the shape as shown in FIG. 2*a*.

FIG. 2*b* is an illustration of an arrangement which can be substituted for the electrodes 12 and 14. The arrangement comprises a magnetic force applying means such as spiral coils 27*a* and 28*a* mounted on iron cores 27*b* and 28*b*, respectively. It is understood in this case that the flow rate control is performed by applying magnetic force to the charged fluid from the charging means 5.

Figure 3:
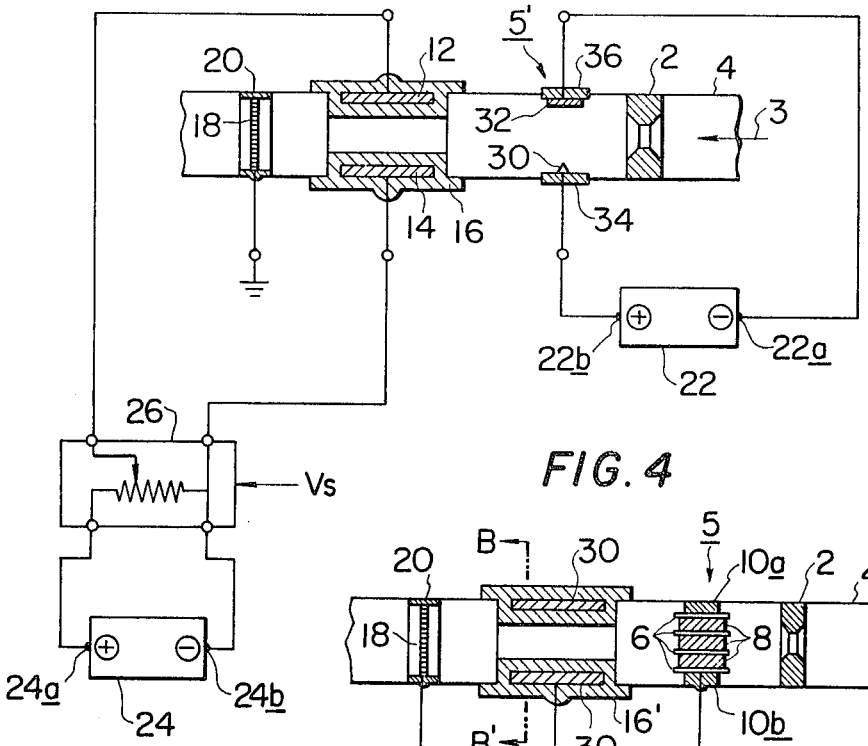
FIG. 3 is an illustration of a second preferred embodiment of the present invention.

FIG. 3 illustrates a second preferred embodiment of the present invention. A difference between the first and the second preferred embodiments is that the charging unit 5 is replaced by another charging unit 5' and the mesh electrode 18 is grounded. This embodiment is very useful for controlling the amount of fluid such as air which is difficult to be charged by the charging means 5 in FIG. 1. As shown, the positive terminal **22*b* is electrically connected to an electrode of needle type, and, on the other hand, the negative terminal 22*a* to an electrode 32 of plate configuration. The electrodes 30 and 32 are installed on insulators 34 and 36**, respectively, producing a corona discharge area therebetween to charge the fluid flowing through the area.

Figure 4:
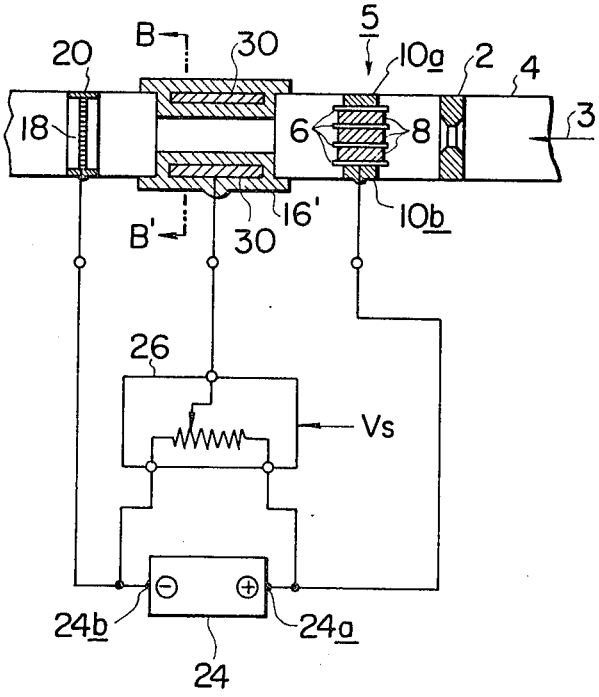
FIG. 4 is an illustration of a third preferred embodiment of the present invention.

FIG. 4 illustrates a third preferred embodiment of the present invention. A main difference between the arrangements of FIGS. 1 and 4 is that the plate-like electrodes 12 and 14 are substituted by a cylindrical electrode 30 surrounded by insulative material 16'. The electrode 30 is connected to the control unit 26 which receives the control signal Vs controlling the voltage applied to the electrode 30. The high voltage power source 24 is connected to the charging means 5 though its positive terminal **24*a* and to the mesh electrode 18 through its negative terminal 24*b*. In this embodiment, the potential of the power source 24 is set within a range of several to several tens of kilo-voltages. With this arrangement, the fluid flow passing through the cylindrical electrode 30 can be controlled by the control signal Vs. In more detail, if the electrode 30 is positively charged, the electrodes 30 expels the fluid flow upstream thereof so that the flow rate decreases in dependence of the positive voltage applied to the electrode 30. On the contrary, if the electrode 30 is negatively charged, the electrode 30 in turn attracts the fluid flow upstream thereof with the result that the flow rate increases in dependence of the negative voltage applied to the electrode 30**.

Figure 5:
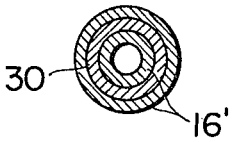
FIG. 5 is a cross sectional view taken along a line B—B' in FIG. 4.

FIG. 5 is a cross sectional view taken along a line B—B' in FIG. 4. As shown, the cross section of the charging means 30 is cylindrical, however, it may be, for example, oval.

Figure 6:
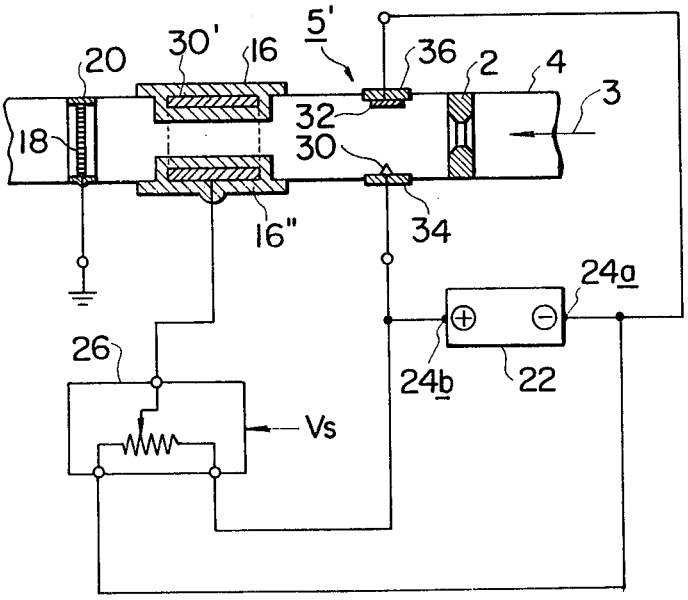
FIG. 6 is an illustration of a fourth preferred embodiment of the present invention.

FIG. 6 is an illustration of a fourth preferred embodiment of the present invention wherein the members corresponding to the elements of FIG. 3 have the same reference numberals. A main difference between the arrangements of FIGS. 3 and 6 is that the plate-like electrodes 12 and 14 are substituted by a cylindrical electrode 30' surrounded by insulative material 16''. The electrode 30' is connected to the high voltage power source 22 through the control unit 26 which receives the control signal Vs controlling the voltage applied to the electrode 30'. The manner how the flow rate is controlled is understood from the description of FIGS. 3 and 4, so that further description will be omitted for brevity.

In the above, the control signal Vs is usually d-c voltage, however, a-c voltage also available. Furthermore, a train of pulses can be employed, in the case of which, in order to control the flow rate, a duty factor of the pulse is changed.

It is apparent that the arrangement of FIG. 2*b* is used in replacement of the electrodes 12 and 14 in FIG. 3.

The apparatus embodying the present invention is useful when, for example, controlling the amount of fuel and/or air applied to an internal combustion engine. In this case, an electrical signal, which represents an engine operational parameter such as the amount of air intaked into the engine, is used as the control signal Vs.

What is claimed is:

1. Apparatus for controlling the amount of fluid flowing through a duct comprising, means defining an orifice in said duct to define a maximum flow rate of the fluid flowing through said duct, first means disposed downstream of said orifice for ionizing a fluid stream having flowed through the orifice in said duct, second means disposed about the path of said ionized fluid stream and downstream of said first means for establishing a field having a transverse force component in said fluid stream to constrict the ionized fluid stream by interaction between the charges in said fluid stream and said transverse force component of the field against an inner surface of said duct to thereby offer resistance to the ionized fluid stream, and third means for varying the magnitude of said field in response to an external signal applied thereto.

2. Apparatus as claimed in claim 1, wherein said first means comprises a plurality of electrically conductive tubes mounted parallel and parallel to the direction of flow of said fluid stream for passing the fluid stream therethrough and electrically connected to a potential.

3. Apparatus as claimed in claim 1, wherein said second means comprises a pair of plate electrodes for generating an electric field in said fluid stream.

4. Apparatus as claimed in claim 1, wherein said duct has a smaller cross-section in a portion where said second means is disposed than the cross-section of the other portion thereof to define a shoulder portion therewith.

5. Apparatus for controlling the amount of fluid comprising:

a pipe through which fluid is adapted to flow in one direction, said pipe being provided with a metering orifice;

charging means within said pipe downstream of said metering orifice, with respect to fluid flowing through said pipe, for ionizing fluid having flowed through said orifice;

means disposed downstream of said charging means and about the path of fluid which has been ionized for establishing a field having a transverse component in the fluid which has been ionized to press the fluid against an inner wall of said pipe so as to provide a resistance to flow of the fluid which has been ionized, whereby the amount of fluid which has been ionized is controlled in accordance with the value of said transverse force component of said field established by said field establishing means;

means coupled with said field establishing means for varying the magnitude of said field; and means disposed in said pipe downstream of said field establishing means, with respect to fluid flowing through said pipe, for discharging charges from the fluid which has passed through said field establishing means.

* * * * *